US007324057B2

(12) United States Patent
Argaman et al.

(10) Patent No.: US 7,324,057 B2
(45) Date of Patent: Jan. 29, 2008

(54) LOW WIND LOAD PARABOLIC DISH ANTENNA FED BY CROSSPOLARIZED PRINTED DIPOLES

(76) Inventors: Gideon Argaman, 7, Haemek st., Tivon 36084 (IL); Shmuel Shtern, 50, Barak st., Kiryat Motzkin 26316 (IL)

( * ) Notice: Subject to any disclaimer, the term of this patent is extended or adjusted under 35 U.S.C. 154(b) by 101 days.

(21) Appl. No.: 11/234,890

(22) Filed: Sep. 26, 2005

(65) Prior Publication Data

US 2007/0069970 A1 Mar. 29, 2007

(51) Int. Cl.
*H01Q 13/00* (2006.01)

(52) U.S. Cl. ..... 343/779; 343/797; 343/897

(58) Field of Classification Search ..... 343/702, 343/786, 781 P, 781 CA, 797, 840, 912, 343/821, 779, 897
See application file for complete search history.

(56) References Cited

U.S. PATENT DOCUMENTS 4,005,433 A * 1/1977 Tsuda ..... 343/819
4,800,393 A * 1/1989 Edward et al. ..... 343/821
4,893,132 A * 1/1990 Habibi ..... 343/912
5,421,376 A * 6/1995 Sinha ..... 139/419
5,952,983 A * 9/1999 Dearnley et al. ..... 343/817
6,067,053 A * 5/2000 Runyon et al. ..... 343/797

* cited by examiner

*Primary Examiner*—Tan Ho
(74) *Attorney, Agent, or Firm*—Angenehm Law Firm; N Paul Friederichs

(57) ABSTRACT

The present invention provides a parabolic dish reflector antenna for wireless communications that is dually polarized for diversity reception purposes while causing minimal visual disturbance for use with cellular base stations and repeaters. The antenna comprises a reflector of paraboloidal shape along both the longitudinal and latitudinal axes of its diameter. The reflector of the antenna is comprised of 4 identical quadrants assembled at the installation site, where each quadrant is made of thin metal ribs with large openings metal mesh stretched and attached to the ribs. The antenna further comprises a feed that is located around the focal point. The antenna feed comprises an open cup-shaped conductive cavity wherein the two orthogonally mounted feeding elements of the antenna located within its volume, are low cost printed circuit board elements.

12 Claims, 4 Drawing Sheets

LOW WIND LOAD PARABOLIC DISH ANTENNA FED BY CROSSPOLARIZED PRINTED DIPOLES

FIELD OF THE INVENTION

The present invention relates to the field of antennas for wireless communication. More particularly it relates to a dual-polarized, field assembled, parabolic dish reflector antenna fed by a cavity-backed crossed-dipole radiator.

BACKGROUND OF THE INVENTION

The present invention is particularly useful for transmission and reception of wireless cellular communications. The invention is suited for use in common frequency bands, such as 800-960 MHz or 1700-2200 MHz. While most common base station antennas cover wide sectors around the base station, the intention of the present antenna is to cover very narrow sectors with dual polarization and pencil beam. Although the antenna is particularly useful in cellular infrastructure, it can also be used in other types of radio communication links and at other frequencies, providing very high gain and dual polarization.

Base stations used in cellular and other wireless communication systems, especially those supporting mobile units, as well as the mobile units themselves, suffer from the well-known problem of multi-path fading. One means to overcome this problem is the use of receive and transmit diversity, which together are also known as diversity reception. In diversity reception, two uncorrelated fading path signals propagate between the signal source and the receiving party. With two uncorrelated signals, each going through a different fading mechanism at any time, there is a good chance that at least one path is received strong enough for data subtraction at any time. One of several known diversity techniques is polarization diversity, where two orthogonally polarized elements provide uncorrelated propagation paths, both in receive and in transmit modes. The antenna of the present invention relates to mutually orthogonal, linearly polarized elements, which can be set to either vertical/horizontal (or 0°/90°) or +45°/−45° relative to the Earth's horizon. Such an antenna is known as cross-polarized or dual-polarized.

The radiating element of a parabolic reflector dish antenna can be constructed of slant +45° and −45° oriented dipoles. Such an arrangement of a pair of crossed dipoles whose mechanical centers are co-located and their linear polarization axes are at 45° with respect to the vertical axes of the antenna, is well known in the art. A dipole radiator located at the focal point of a parabolic reflector dish does not provide the optimal feed element for such an arrangement due to different radiation patterns for E and H planes. An improved dipole radiation scheme is provided by mounting the feeding half-wavelength cross dipole at the mouth of a shallow cylindrical metal cavity. U.S. Pat. No. 4,109,254 and U.S. Pat. No. 4,005,433 disclose the use of crossed dipoles located at the mouth of a circular cavity and feeding a parabolic reflector with coaxial feeds coming through the dipole base where the balanced-to unbalanced transformers (BALUNs) are located. With this arrangement, one or more annular chokes may be provided around the cavity to further shape-feed radiation pattern and reduce the side lobes and back lobe of the composite radiator.

In contrast to the mechanically machined dipole elements and BALUN used in these previous techniques, the present invention discloses a unique structure of lower cost printed circuit board (PCB) technology to implement the crossed-dipole feed elements of a dish reflector antenna.

A printed cross-dipole radiator is described in Japanese patent application JP 2001/168637, which shows a miniaturized cross dipole using printed circuit board. (PCB) technology. However, neither this nor any other solutions known to the inventors disclose a true crossover feeding line arrangement of orthogonal radiating element boards that are DC-short-circuited to ground, thereby providing reliable lightning protection. Nor do these prior art solutions provide perpendicular PCB dipoles mounted within a metal cap-shaped cavity, feeding a parabolic dish reflector.

The use of a parabolic reflector dish is not common in the cellular communication industry due to size and general appearance of such antennas. The large size is a consequence of the physical requirement that the diameter of the dish be at least four times the maximum wavelength in use. With a maximum cellular band wavelength of 37 cm, the minimum dish diameter would be 1.4 meters or in practice 2 meters. The visual impact of cellular base station towers on communities and individuals has become a major concern. It is thus a vital necessity to reduce the size or (if physically impossible) the visual impact of the base station towers and antennas on their surroundings.

The common means for reducing the visual impact, as well as the wind load and weight, of a parabolic dish reflector is to use a metal grid, such that the large dish will appear to be substantially transparent. U.S. Pat. No. 5,421,376 and U.S. Pat. No. 5,456,759 disclose a collapsible parabolic dish made from rigid ribs and metalized mesh fabric. These prior art patents use very fine cross woven metalized mesh which might be light but certainly not transparent. By contrast, the present invention discloses a parabolic reflector which is field assembled of four identical quadrants while each is made of rigid ribs and relatively very large spacing cross woven metal grid which are larger than the useful wavelength over 10 ($\lambda/10$). This quality is enabled since all metal wires of the reflector of this invention are parallel to the electric field lines radiated towards the reflector.

U.S. Pat. No. 4,893,132 describes a parabolic dish antenna which is assembled out of four quadrants. The present invention presents a parabolic reflector assembled of four quadrants as well but as opposed to previous art these quadrants are made of cross woven metal mesh where all wires in any of the quadrants are parallel to the wires in all other three quadrants thus making all quadrants identical and simpler to manufacture.

Parabolic dish reflector antennas used for cellular communications are vertically linearly polarized with the reflector being made of parallel, spaced metal rods, or fins, spaced apart a distance that is less than the wavelength divided by 10 ($\lambda/10$). U.S. Pat. No. 5,191,350 discloses a single vertical polarization antenna using a parabolic reflector having very large openings. The reflector presented in that patent is made out of parallel metal rods so as to support a single polarization only and can be assembled of two identical sections. By contrast, in the present invention the parabolic dish reflector is made of a cross-woven metal grid with large openings, enabling dual cross polarization radiation.

It is an intention of this invention to provide a parabolic dish reflector antenna that is dually polarized for diversity reception purposes while causing minimal visual disturbance for use with cellular base stations and repeaters. The parabolic reflector dish is built from four identical quadrants that are made from cross-woven metal wire with large openings and that can be assembled in the field to compose a full reflector wherein all grid wires are parallel to the cross-polarized electrical fields.

It is further the intention of this invention to provide a cross-dipole feed for illuminating the parabolic reflector dish antenna, and which is implemented by printed circuit board technology (PCB), enabling lower cost assemblies.

The present invention also discloses the application of a parabolic dish reflector antenna as a high gain dual polarization antenna in the cellular infrastructure. The practical requirements of base station and repeater antennas, known to those familiar with the cellular infrastructure industry, prevent the use of higher gain dual polarization dish antennas due to large size, heavy weight, high wind load stress on the tower or pole, and visual stress on nearby communities served by the cellular network.

The antenna structure disclosed by this invention makes such high gain dually polarized antennas applicable for cellular infrastructure. Other features and advantages of the present invention will become apparent to those skilled in the art from a reading of the following detailed description constructed in accordance with the accompanying drawings wherein:

It is an object of the present invention to provide an antenna for cellular base stations that supports dual polarization signaling for signal combining and polarization diversity.

It is a further object of the present invention to provide an antenna that is capable of very high gain with narrow beam width on both azimuth and elevation with very low side lobes.

It is a further object of the present invention to provide a dish reflector antenna that has very low visual impact on the environment and that has reduced wind load due to its mesh structure.

It is a further object of the invention to provide an antenna that can be field assembled to minimize transportation expenses.

It is a further object of the present invention to provide orthogonally-arranged printed dipole structures including crossover feeding lines and BALUNs, collocated and having the same phase-center within a circular cavity.

It is a further object of the present invention to provide a dielectric stud rigidly supporting printed circuit board dipoles location at the center of a conductive circular cavity.

It is a further object of the present invention to provide an inherent DC grounding arrangement for the radiating elements, enabling lightning-induced currents to be shunted to ground.

These and other objectives of the invention are provided by an improved antenna system for cellular base transmission stations.

BRIEF DESCRIPTION OF THE INVENTION

It is thus provided in accordance with a preferred embodiment of the present invention, an antenna for wireless communications comprising.

a reflector of paraboloidal shape along both the longitudinal and latitudinal axes of its diameter, said reflector having an inner dish surface and having a focal point at a distance from the reflector on an axis perpendicular to a center of said inner dish surface.

feed of the antenna, the feed being located around the focal point and on an axis perpendicular to said center of said inner dish surface, an open cup-shaped conductive cavity having said feed of the antenna located within its volume, the cavity having a flat bottom and mounted with an opening facing said inner dish surface.

Furthermore, in accordance with another preferred embodiment to the present invention, said reflector comprises four identical quadrants.

Furthermore, in accordance with another preferred embodiment to the present invention, said four identical quadrants are made of thin metal ribs with metal mesh stretched and attached to the ribs at discrete points.

Furthermore, in accordance with another preferred embodiment to the present invention, said metal mesh comprises conductive metal wires arranged in a perpendicular pattern, the minimum width of the mesh openings being $\lambda/20$, where $\lambda$ is signal's lowest wavelength.

Furthermore, in accordance with another preferred embodiment to the present invention, said conductive metal wires run along electrical polarization vectors of radiating elements, which are +/−45 degrees to Earth's horizon.

Furthermore, in accordance with another preferred embodiment to the present invention, said conductive metal wires run along electrical polarization vectors of radiating elements, which are parallel with Earth's horizon and perpendicular to Earth's horizon respectively.

Furthermore, in accordance with another preferred embodiment to the present invention, said conductive metal wires run parallel in all four quadrants of the antenna reflector when assembled.

Furthermore, in accordance with another preferred embodiment to the present invention, said feed comprises two dipoles, the dipoles perpendicular to one another and orthogonally intersecting substantially at their midlines, and two dielectric boards each provided on one of said two dipoles wherein said two dielectric boards have edges that are coplanar with each other and positioned substantially flush with said opening of said open cup-shaped conductive cavity.

Furthermore, in accordance with another preferred embodiment to the present invention, said two dielectric boards are substantially thin wherein each board has two sides provided with a metal conductor layer.

Furthermore, in accordance with another preferred embodiment to the present invention, said two dipoles are collocated and suspended at a center of said cup-shaped conductive cavity by a dielectric stud such that the dipoles are flush with the cavity opening.

Furthermore, in accordance with another preferred embodiment to the present invention, each dipole is fed by a BALUN, said BALUN printed on one side of the dielectric board and the BALUN's ground plane on the other side of the board, the dipole oriented so that the BALUN is located on said axis perpendicular to the center of said inner dish surface and closer to the center of the inner dish surface of the reflector than the dipole.

Furthermore, in accordance with another preferred embodiment to the present invention, said BALUN is connected to a coaxial feed line that runs straight to said center of the antenna reflector and on to a base station transceiver.

Furthermore, in accordance with another preferred embodiment to the present invention, each of said two dipoles is fed by a BALUN, the BALUN printed on one side of the dielectric board and the BALUN's ground plane on the other side of the board.

Furthermore, in accordance with another preferred embodiment to the present invention, each of said two dipoles is fed by a printed microstrip impedance-matching feed line, wherein the two microstrip feed lines provided on said two dipoles cross each other at midline intersection in a symmetrical manner and feed each of said two dipoles exactly at the same point, wherein phase centers of the dipoles are exactly at the same point on both dipoles.

Furthermore, in accordance with another preferred embodiment to the present invention, each dipole further comprises a conductive plated-through-hole, the hole shorting the printed microstrip feed line and one dipole arm.

Furthermore, in accordance with another preferred embodiment to the present invention, the printed microstrip feed line shorts the dipole elements to ground for DC and low frequency signals.

Furthermore, in accordance with another preferred embodiment to the present invention, the low frequency signals comprise lightning spectra induced signals.

Additionally and in accordance with yet another preferred embodiment to the present invention, each of said two dipoles has a phase center substantially at the center of the dipole, and wherein when said two dipoles are co-located at substantially a same height above a cavity center, phase centers of the dipoles are co-located.

BRIEF DESCRIPTION OF THE FIGURES

The invention is described herein, by way of example only, with reference to the accompanying Figures, in which like components are designated by like reference numerals.

DETAILED DESCRIPTION OF THE INVENTION AND THE FIGURES

The present invention is particularly useful for wireless cellular communications systems infrastructure. The invention is suited for use in common frequency bands, such as 800-960 MHz or 1700-2200 MHz. While most common base station antennas cover wide sectors around the base station, the intention of the present antenna is to cover very narrow sectors with dual polarization and pencil beam. Although the antenna is particularly useful in cellular infrastructure, it can also be used in other types of radio communication links and at other frequencies, providing very high gain and dual polarization.

An antenna according to a preferred embodiment of the present invention comprises a parabolic dish reflector and an antenna feed.

Figure 1:
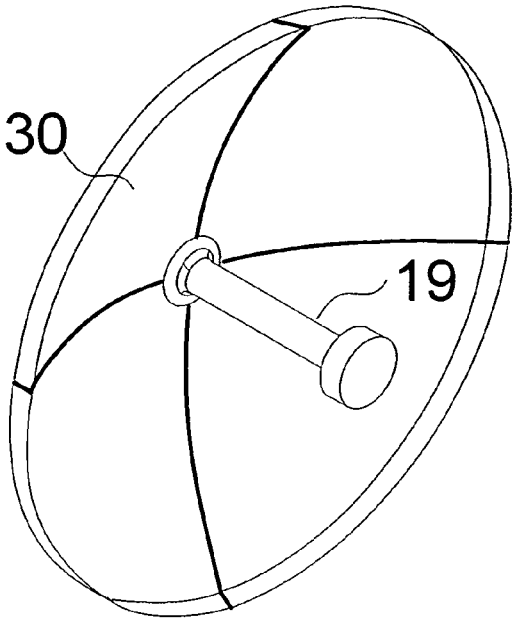
FIG. 1 is an isometric view of a parabolic dish reflector with the antenna feed assembly located at its focal point and mounted on a dielectric support structure rising from the center of the reflector dish in accordance with a preferred embodiment of the present invention.

FIG. 1 illustrates an antenna with a parabolic dish reflector comprising four quadrants 30 and an antenna feed assembly 19 in accordance with a preferred embodiment of the present invention. The parabolic reflector dish is made up of four identical quadrants 30 assembled together by fastening means common in the industry, such as metal screws and bolts. At the center of the dish a non-conductive support structure 20 rises perpendicular to the center of the inner dish surface and to the focal point of the parabolic dish, where the antenna feed is located.

Figure 2:
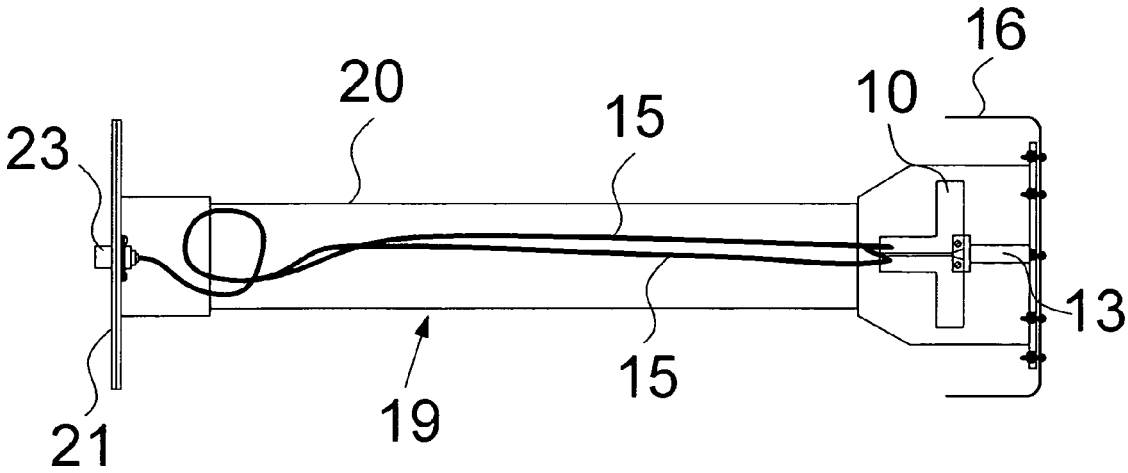
FIG. 2 is a cross-sectional view of an antenna feed assembly comprising a mounting plate, transmission lines, printed crossed dipoles, cavity, support structure, and antenna feed located at the focal point of the parabolic reflector in accordance with a preferred embodiment of the present invention.

Antenna feed assembly 19 is shown in detail in FIG. 2. The structure of antenna feed 19 is designed for mutually orthogonal, linearly-polarized radiating elements 10 comprising printed circuit boards and with the electrical field of each element 10 parallel to a straight line going from one half of each dipole to the other half of that dipole The electrical field direction denotes the polarization which can be set to either vertical/horizontal (or 0°/90°) or dual-slant (+45°/−45°) relative to the Earth's horizon. Such an antenna is known as cross-polarized or dual-polarized. Radiating elements 10 are printed dipoles mounted on dielectric stud 13. Radiating elements 10 are centered within, and flush with the edges of, cup-shaped conductive cavity 16. Cup-shaped conductive cavity 16 is comprised of a conductive material, such as metal or a dielectric covered with a layer of metal, and comprises a flat bottom extending to a diameter greater than the width of radiating element 10 before curving up to form the wall of the cup shape, the wall ending at a point at the same level as radiating element 10. Radiating element 10 comprises two orthogonally-oriented printed circuit boards (dielectric boards with a conductive layer on each side), each having an inverted-T-shape with the top of the T parallel to the bottom of cup-shaped cavity 16 and with the stem of the T extending towards the dish reflector quadrants 30. Dielectric rigid support structure 20 covers radiating elements 10 for physical protection and is attached firmly to the bottom of cup-shaped cavity 16. A feed line comprising coaxial cable 15 is attached to each radiating element 10 and runs through dielectric support structure 20 to coaxial cable connector 23 mounted on metal plate 21, which is attached to dielectric support structure 20. From coaxial cable connector 23 the feed line runs to a base station. Dielectric support structure 20, together with metal plate 21 and cup-shaped cavity 16 form a sealed environment housing radiating elements 10 and coaxial cables 15. Metal plate 21 attaches to the center of the dish comprising dish reflector quadrants 30.

Figure 3A:
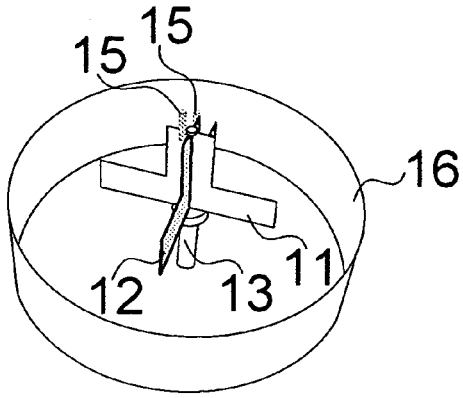
FIG. 3A is an isometric view of the feed structure of the present invention.
Figure 3B:
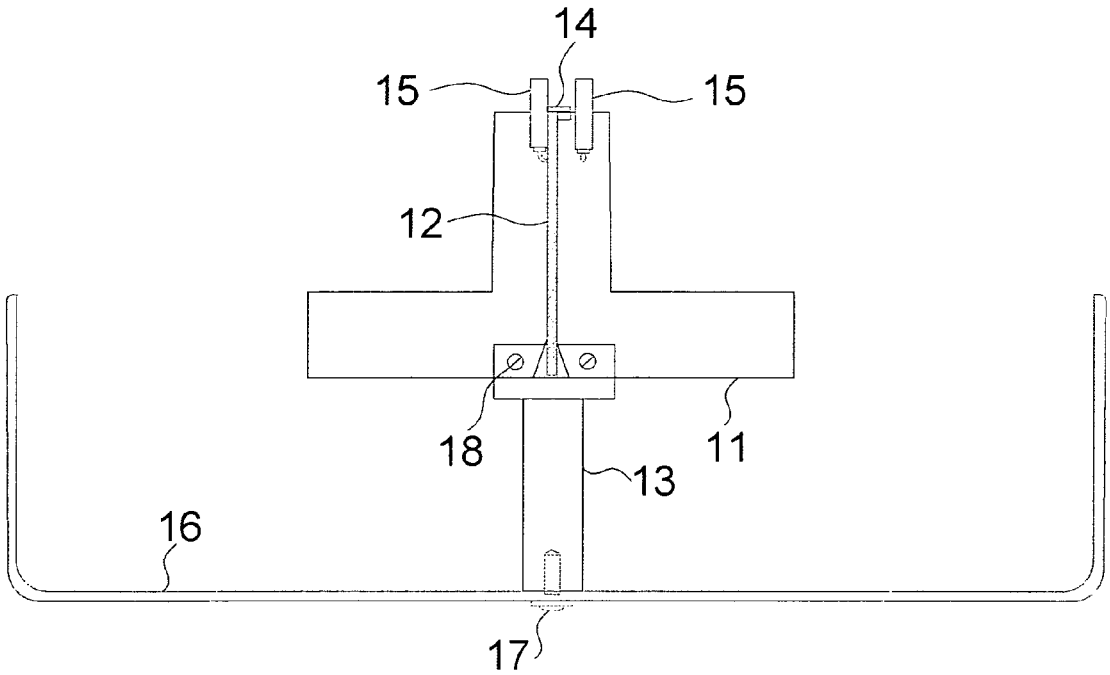
FIG. 3B is a cross sectional view of the feed structure of the present invention.

More details of radiating antenna feed 10 are shown in isometric view in FIG. 3A and in cross section view in FIG. 3B. Antenna feed 10 comprises T-shaped printed circuit boards 11 and 12 mounted perpendicular to one another. Boards 11 and 12 comprise printed radiating elements shown respectively in FIGS. 4A/4B and FIGS. 5A/5B. Boards 11 and 12 are mounted on dielectric stud 13, their tops parallel with the bottom of cup-shaped cavity 16. This mounting position is required so that assembled radiating element boards 11 and 12 will be matched to the required impedance, have a co-located phase centers, and have the same radiating patterns on both polarizations. Dielectric stud 13 is attached to the bottom of cup-shaped cavity 16 bottom by fasteners 17, which are typically screws but can be any element known in the art and suitable for creating a rigid attachment between bodies.

Boards 11 and 12 are held together and to dielectric stud 13 with fasteners 18 at one end (the middle of the top of their "T" shape) and are held together with metal cap 14 at their other end (bottom of stem of their "T" shape). Metal cap 14 is made of a solderable plating, non-ferrous metal, such as brass, and soldered (or otherwise conductively connected) to the ground plane of each board 11 and 12. The center conductors of flexible coaxial cables 15 are soldered to respective plated-through holes 114 and 124 on respective boards 11 and 12, thereby connecting the printed radiating elements (boards 11 and 12) to the rear mounted connector 23 on the rear panel of antenna 21. It will be noted that coaxial cables 15 are not required to provide structural support (which instead is provided by support structure 20), therefore they can be inexpensive flexible cables rather than specially machined rigid cables. A benefit of coaxial cables 15 running directly from printed radiating elements 11 and 12 to the rear panel of the antenna dish 21 is the shorter path with resulting lower signal loss in the coaxial cables. Yet another benefit of this structure is that the coaxial cables are coaxial with the axis perpendicular to the center of the inner dish surface of the reflector and thus do not distort the symmetry of the radiation pattern.

Figure 4A:
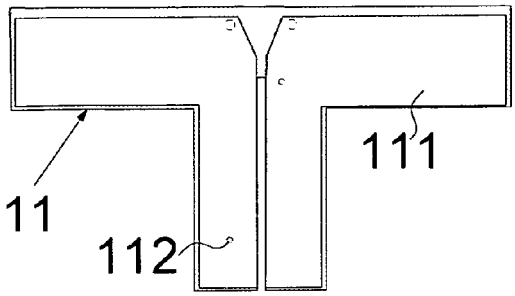
FIGS. 4A and 4B are respectively views of a proximal side and a distal side of one of the pair of printed dipole radiating elements of the present invention.
Figure 4B:
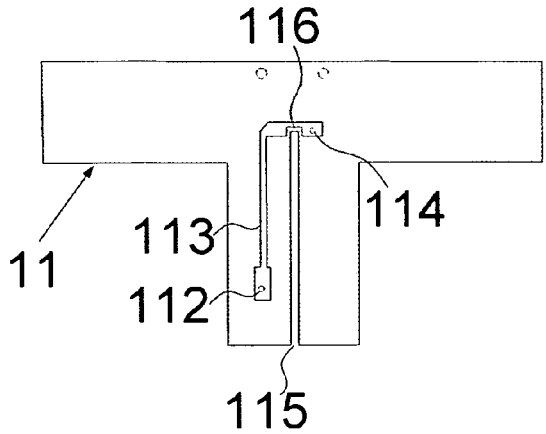

A more detailed view of radiating dielectric board 11 is shown in FIG. 4A (proximal side) and FIG. 4B (distal side). (The appellations "proximal" and "distal" are used descriptively here to differentiate between the two sides of board 11). On the proximal side (FIG. 4A), are printed two inverted L-shaped conductors 111 and 112. Each L-shaped conductor establishes half a dipole, the ground plane for microstrip transmission line 113, and BALUN (balanced to unbalanced) transformers. A conducting plated-through hole 112 is connected to microstrip transmission line 113 printed on the distal side of dielectric board 11.

With further reference to the distal side of dielectric board 11 (FIG. 4B), microstrip transmission line 113 connects plated-through hole 112 with another plated-through hole 114, thereby connecting transmission line 113 to one arm of L-shaped conductor (111) printed on the proximal side of the board and comprising one half of the printed dipole. Microstrip transmission line 113 also acts as an impedance matching transformer between the coaxial feed line 15 and dipole 11. Slot 115 between the two L-shaped conductors (111 or 112) establishes part of the BALUN transformer, which is well known to those familiar with the craft, and which also comprises orthogonal board 12 when boards 11 and 12 are assembled together, thereby forming the radiating element 10 of the antenna. A special notice should be given to etched recess 116 in microstrip line 113 enabling microstrip line 113 detour mechanical slit 115 above mechanical slit 115.

Figure 5A:
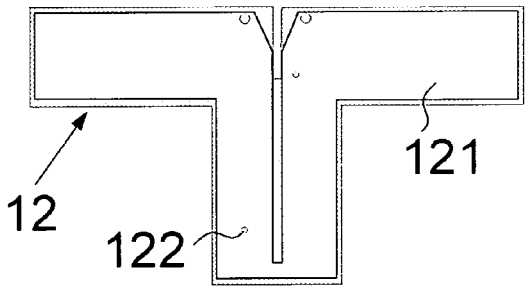
FIG. 5A and FIG. 5*b* are respectively views of a proximal side and a distal side of the other printed dipole of the pair of radiating elements of the present invention.
Figure 5B:
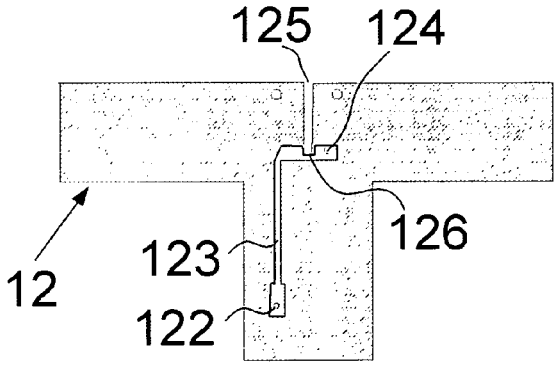

A more detailed view of the orthogonal printed radiating dielectric board 12 is shown in FIG. 5A (proximal side) and FIG. 5B (distal side). (Again, the appellations "proximal" and "distal" apply descriptively).

Perpendicular printed radiating board 12 is similar in structure to board 11 but has certain distinct differences. Printed board 12 carries on its proximal side (FIG. 5A) two inverted L-shaped conductors, 121 and 122, but in this case they are joined at the ends of their stems with slot 125 between their bases. Plated-through-hole 122 is connected to microstrip transmission line 123 on the distal side (FIG. 5B) of board 12. Transmission line 123 connects, and matches impedances, between feed hole 122 and the dipole 12 feed at plated-through-hole 124. Hole 124 connects feed line 123 with one arm 121 of dipole 12. A special notice should be given to etched recess 126 in microstrip line 123 enabling microstrip line 123 detour mechanical slit 125 below slit 125.

When boards 11 and 12 are placed perpendicular to each other, slit 115 of board 11 receives board 12 while slit 125 receives board 11. It should be noted too that feed line 113 of board 11 (FIG. 4B), due to its recess, goes above slit 115 while feed line 123 of board 12 (FIG. 5B) due to its opposite recess goes below slit 125. When assembled orthogonally to one another in this fashion, each board fits into the slits on the other board in such a way that feed lines 115 and 123 cross each other at the same location on both boards, enabling crossover feeding lines to feed each dipole exactly at the same physical point and same electrical performance. Another point to notice is that due to the structure described, the feed line of each of the boards is DC grounded when assembled. This is particularly important when lightning-induced voltage might harm the radiating element.

Figure 6:
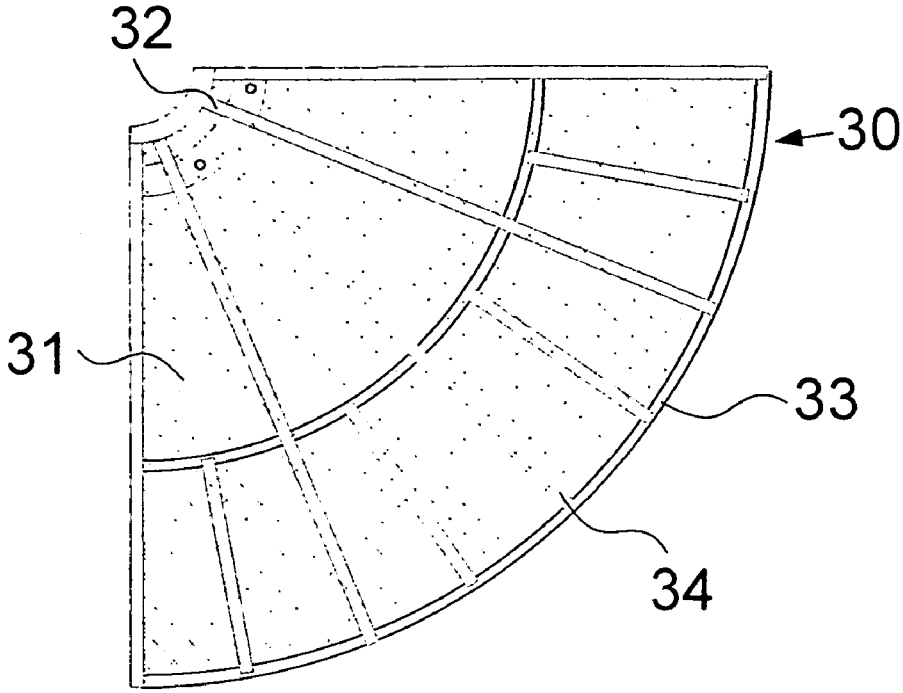
FIG. 6 is a front view of a single reflector quadrant and the conductive wire mesh orientation of the reflector embodiment of the present invention.

FIG. 6 shows one quadrant 30 out of four such quadrants comprising the parabolic reflector dish of the present invention. The dish is comprised of several radial thin-metal or dielectric-material ribs 32 joined together (for example, by brazing) with circular ribs 33 to form a lightweight construction. A mesh comprising perpendicular metal wires 31 is mounted on the construction surface and attached to it by spring clips or any other conducting or non-conducting means to form a parabolic shaped conductive surface. The mesh openings can be as large as preferably $\lambda/10$ (where $\lambda$ is the signal wavelength) and ratio of the metal mesh conducting wire's diameter to the mesh opening can be as low as 1/20. The relatively large openings and thin wires of the mesh make the reflector dish visually transparent with minimal wind load. The metal mesh conducting wires must be oriented as shown in FIG. 6, such that one of the wire directions is coaxial with the central radial rib 34. With the mesh oriented correctly in all four quadrants of the antenna reflector, a first half of the mesh grid lines are parallel to each other and parallel with the electrical field vector of one of the radiating elements 10 of the antenna feed (shown in FIG. 1) while the second half of the mesh grid lines are parallel to each other, parallel with the electrical field vector of the other radiating element, and perpendicular to the first half of the mesh grid lines.

Figure 7:
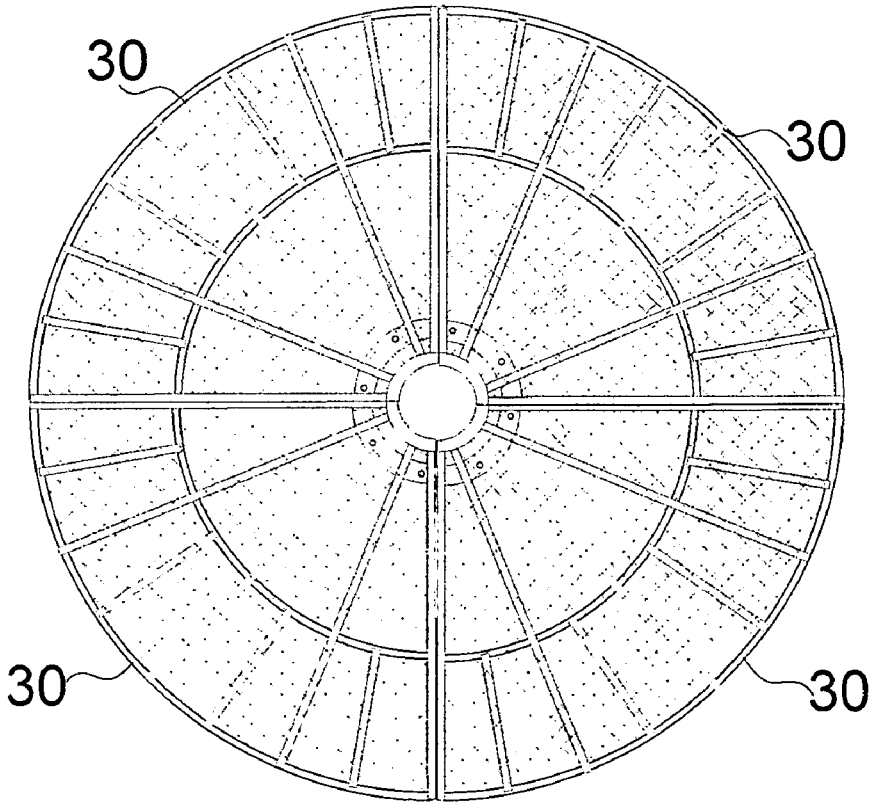
FIG. 7 is a front view of the reflector embodiment comprised of four identical quadrants of FIG. 6.

FIG. 7 presents the entire assembled antenna reflector dish comprising four quadrants 30. The metal mesh grid lines in all four quadrants are parallel to each other. Assembly of the dish can easily be done in the field.

Although particular embodiments of the invention have been described herein, it should be understood and recognized that modifications and variations in the detailed application may be obvious to those skilled in the art and therefore it is intended that the claims be interpreted to cover such modifications and equivalents.

The invention claimed is:

1. An antenna for wireless communications comprising:

a reflector of paraboloidal shape along both the longitudinal and latitudinal axes of its diameter, said reflector having an inner dish surface and having a focal point at a distance from the reflector on an axis perpendicular to a center of said inner dish surface, wherein said reflector comprises four identical quadrants;

feed of the antenna, the feed being located around the focal point and on an axis perpendicular to said center of said inner dish surface;

an open cup-shaped conductive cavity having said feed of the antenna located within its volume, the cavity having a flat bottom and mounted with an opening facing said inner dish surface;

and wherein said four identical quadrants are made of thin metal ribs with metal mesh wires stretched and attached to the ribs at discrete points while wires in all four quadrants are directed exactly the same.

2. The antenna as claimed in claim 1 wherein said metal mesh comprises conductive metal wires arranged in a perpendicular pattern, the minimum width of the mesh openings larger than $\lambda/10$, where $\lambda$ is signal's lowest wavelength.

3. The antenna as claimed in claim 2 wherein said conductive metal wires run along electrical polarization vectors of radiating elements, which are +/−45 degrees to Earth's horizon.

4. The antenna as claimed in claim 2 wherein said conductive metal wires run along electrical polarization vectors of radiating elements, which are parallel with Earth's horizon and perpendicular to Earth's horizon respectively.

5. The antenna as claimed in claim 2 wherein said conductive metal wires run parallel in all four quadrants of the antenna reflector when assembled.

6. The antenna as claimed in claim 1 wherein said feed comprises two dipoles, the dipoles perpendicular to one another and orthogonally intersecting substantially at their midlines, and two dielectric boards each provided on one of said two dipoles wherein said two dielectric boards have edges that are coplanar with each other and positioned in said opening of said open cup-shaped conductive cavity, and wherein said two dielectric boards are substantially thin wherein each board has two sides provided with a metal conductor layer, and wherein said two dipoles are collocated and suspended at a center of said cup-shaped conductive cavity by a dielectric stud such that the dipoles are flush with the cavity opening mounted at an optimum height above the cavity bottom and specifically $\lambda/4$, rendering the whole structure with wider bandwidth.

7. The antenna as claimed in claim 6 wherein two co-located dipoles are fed by two BALUNs, said each of the two BALUNs printed on one side of the dielectric board and the BALUN's ground plane on the other side of the board, the dipole oriented so that the two BALUNs are located on said axis perpendicular to the center of said inner dish surface and closer to the center of the inner dish surface of the reflector than the dipole and where said two BALUNs are connected to a coaxial feed lines that runs straight to said center of the antenna reflector and on to a base station transceiver.

8. The antenna as claimed in claim 1 wherein said feed comprises two dipoles, the dipoles perpendicular to one another and orthogonally intersecting substantially at their midlines, and two dielectric boards each provided on one of said two dipoles wherein said two dielectric boards have edges that are coplanar with each other and positioned substantially flush with said opening of said open cup-shaped conductive cavity and wherein said two dielectric boards are substantially thin wherein each board has two sides provided with a metal conductor layer and wherein each of said two dipoles is fed by a printed microstrip impedance-matching feed line, wherein the two microstrip feed lines provided on said two dipoles cross each other at midline intersection in a symmetrical manner and feed each of said two dipoles exactly at the same point, wherein phase centers of the dipoles are exactly at the same point on both dipoles and wherein each of said two dipoles has a phase center substantially at the center of the dipole, and wherein when said two dipoles are co-located at substantially a same height above a cavity center, phase centers of the dipoles are co-located.

9. The antenna as claimed in claim 8 wherein each dipole further comprises a conductive plated-through-hole, the hole shorting the printed microstrip feed line and one dipole arm.

10. The antenna as claimed in claim 9 wherein the printed microstrip feed line shorts the dipole elements to ground for DC and low frequency signals.

11. The antenna as claimed in claim 10, wherein the low frequency signals comprise lightning spectra induced signals.

12. The antenna as claimed in claim 8, wherein a grooved metal cap is provided soldering together the ground plains of the two dipoles so as to render the diploes good mutual grounding and mechanical rigidity.

* * * * *